US005890666A

United States Patent [19]

Fõlling et al.

[11] Patent Number: 5,890,666

[45] Date of Patent: Apr. 6, 1999

[54] IMPACT CRUSHER

[75] Inventors: Klaus Fõlling, Ennigerloh; Werner Krokor, Beckum, both of Germany

[73] Assignee: Krupp Fordertechnik GmbH, Essen, Germany

[21] Appl. No.: 7,506

[22] Filed: Jan. 15, 1998

[30] Foreign Application Priority Data

Jan. 31, 1997 [DE] Germany ..... 197 03 583.3

[51] Int. Cl.[6] ..... B02C 13/02

[52] U.S. Cl. ..... 241/189.1; 241/285.3

[58] Field of Search ..... 241/189.1, 285.2, 241/285.3

[56] References Cited

U.S. PATENT DOCUMENTS

| | | | |
|---|---|---|---|
| 3,343,800 | 9/1967 | Rasmussen | 241/47 |
| 3,480,214 | 11/1969 | Wageneder | 241/189.1 |
| 5,435,050 | 7/1995 | Alt | 241/189.1 X |
| 5,490,636 | 2/1996 | Schrodl | 241/189.1 |
| 5,713,527 | 2/1998 | Hemesath et al. | 241/189.1 |

FOREIGN PATENT DOCUMENTS

| | | |
|---|---|---|
| 23 31 729 | 1/1975 | Germany . |
| 43 12 509 | 10/1994 | Germany . |
| 43 43 406 | 12/1994 | Germany . |

*Primary Examiner*—John M. Husar
*Attorney, Agent, or Firm*—Herbert Dubno

[57] ABSTRACT

An impact crusher with a rotor and one or more impact members interconnected to form an adjustable impact member system, a first impact member being mounted pivotally around a first horizontal axis by way of at least one drive means, on the second horizontal axis of which a further impact member, pivotal by way of at least one drive means, is provided, in which context the horizontal axis pivotally supporting the impact member is provided in the region of that end of the first impact member which is remote from the horizontal axis and the second impact member comprises one or more levers.

6 Claims, 3 Drawing Sheets

IMPACT CRUSHER

FIELD OF THE INVENTION

Our present invention relates to an impact crusher of the type in which a rotor is provided with crushing elements which cooperate with impact members which cooperate to form a crushing gap and to an impact member assembly suitable for use with such a rotor. More particularly the invention relates to an impact crusher comprising a rotor and two or more impact members interconnected to form an adjustable impact member system, a first impact member being mounted pivotally around a first horizontal axis by way of at least one drive means, and having a second horizontal axis on which a second impact member, pivotal by way of at least one drive means, is provided.

BACKGROUND OF THE INVENTION

An impact crusher for crushing material of various consistencies is known for example from DE 23 31 729 A1 in which the impact plates are interconnected in articulated manner to form a coherent composite pivotal impact member, each of the interconnected impact plates deriving adjustable support individually from the housing.

The impact plates may have impact surfaces which are at angles to one another or are stepped along the path of the material as it is entrained from the inlet side of the machine. The principles of such machines have also been developed in the Chemical Engineers Handbook, Perry and Chilton, 5th edition, McGraw Hill Book Company, New York, 1973, at Chapter 8, pages 19 ff.

This known impact crusher, just like impact other crushers of the same genus, suffers from the substantial drawback that the upper impact member, provided downstream of the machine inlet yields outwardly due to foreign objects which cannot be crushed entering the machine, so that the crushing gap between the rotor and the lower impact member is decreased to such an extent, due to the upper impact member pivoting outwardly, that a risk arises of foreign objects getting wedged between the rotor and the impact member, leading to possible damage to the rotor and/or the impact member, so that the continued operability of the installation can no longer be ensured.

OBJECTS OF THE INVENTION

It is the principal object of the present invention to provide an improved impact crusher such that the damage which can be caused by the entry of a noncrushable foreign object can be minimized.

Another object of the invention is to provide an improved impact crusher which is free from the drawbacks of earlier devices or apparatuses of this type and particularly the drawbacks mentioned above.

Still another object of this invention is to provide improved impact assembly for a rotor-type crusher or breaker whereby drawbacks which could have resulted in down time can be avoided.

SUMMARY OF THE INVENTION

These objects are attained, in accordance with the invention in an impact crusher of the type in which a rotor and two or more impact members are provided along the path of the crusher members of the rotor to form an adjustable impact assembly. A first impact member is pivotally mounted at a first horizontal axis and a second impact member is pivotally mounted on the first impact member by a second horizontal axis and respective drive means is provided for controlling the displacement of the impact members.

According to the invention, the horizontal axis pivotally supporting the second impact member is provided in the region of that end of the first impact member which is remote from the first horizontal axis and the second impact member comprises one or more levers.

It is an important feature of the invention that due to the specific arrangement of the point of engagement for the support and the point of articulation of the lower impact member to the lever, the crushing gap between the lower impact member and the rotor is enlarged in the event of the upper impact member yielding due to foreign object interference.

Because of the geometrical relationships with regard to the cylinder hinge point and the axes of the impact members, the edge of the lower impact member closest to the rotor is moved automatically in such a manner during opening of the impact member, for which purpose a housing member is swiveled around the pivotal axis, that the edge does not collide with the rotor or the beater bars, thus preventing damage.

Different drive means, preferably hydraulic cylinders, may be employed in order to adjust the two impact members.

More particularly, the impact crusher can comprise:

a housing;

an impact crusher rotor rotatable in the housing about a horizontal rotor axis; and at least one impact member assembly in the housing adjustable relative to the rotor, the assembly including:

a first impact member having impact surfaces juxtaposed with the rotor and pivotally mounted in the housing for movement about a first horizontal pivot axis to shift the surfaces toward and away from the rotor, a first drive means articulated to the first impact member for angularly displacing the first impact member about the first horizontal pivot axis, a second impact member having impact surfaces juxtaposed with the rotor and pivotally mounted in the housing for movement about a second horizontal pivot axis on the first impact member at a location remote from the first horizontal pivot axis to shift the surfaces of the second impact member toward and away from the rotor, at least one lever swingable about the second horizontal pivot axis and operatively connected with the second impact member for pivotally displacing same about the second horizontal pivot axis, and second drive means articulated to the lever for angularly displacing the second impact member about the second horizontal pivot axis.

The impact crusher according to the invention is characterized by a particularly high operational reliability and, therefore, a particularly long useful life due to the advantageous arrangement of the point of engagement for the support of the lower impact member.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
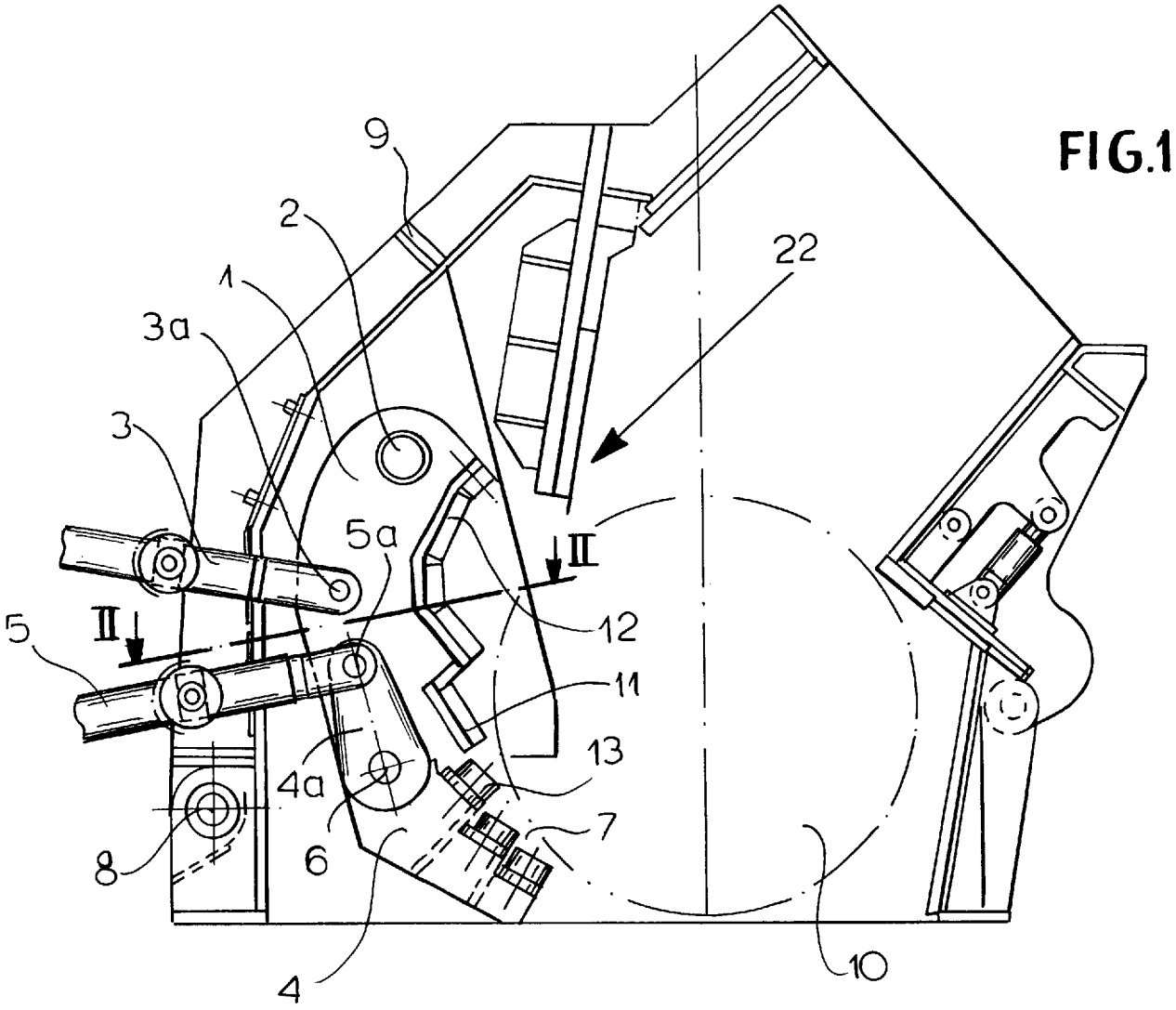
FIG. 1 is a diagrammatic transverse section through an impact crusher according to the invention.
Figure 1A:
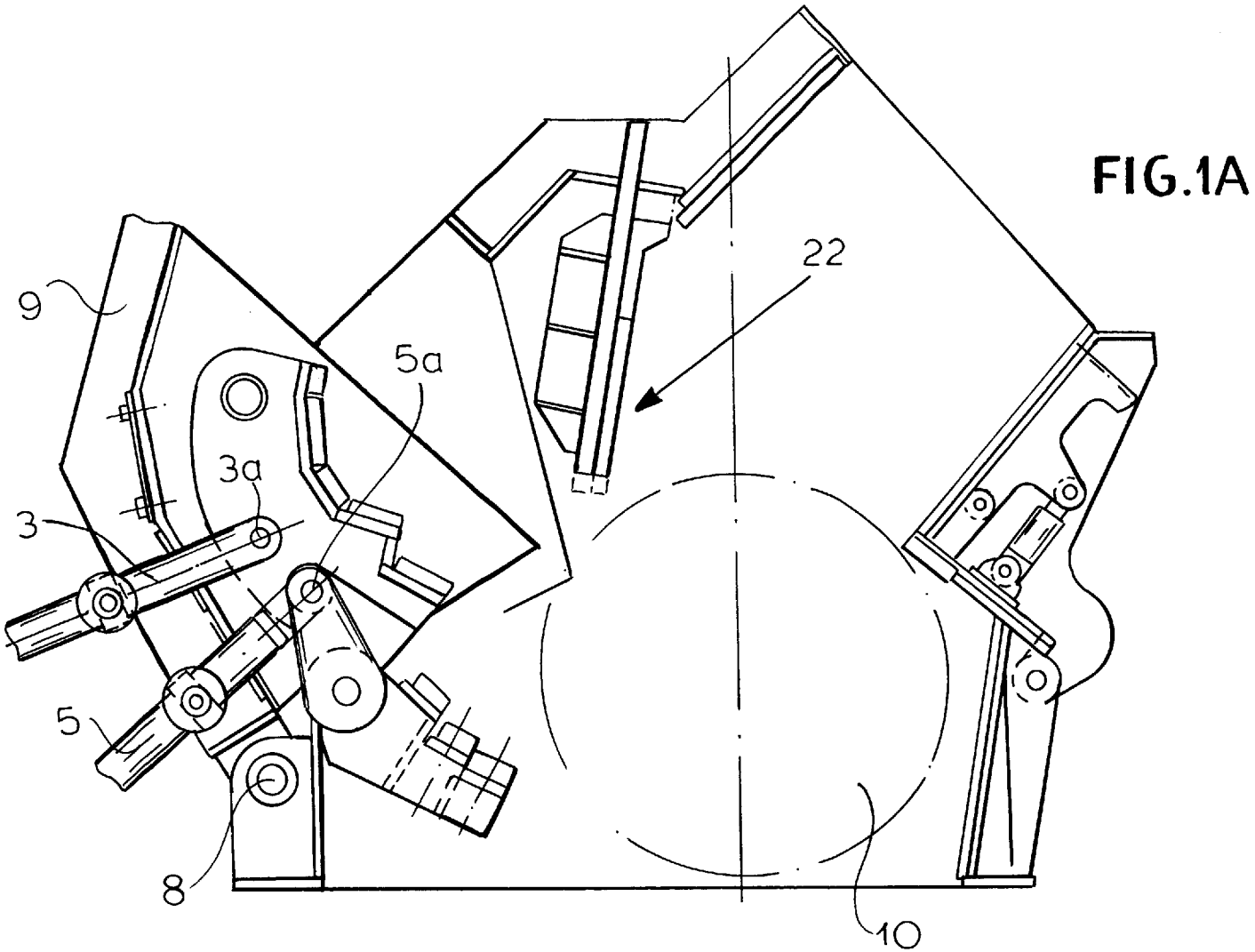
FIG. 1A is the impact crusher of FIG. 1, shown with pivotal housing in open position.

The impact crusher illustrated in FIG. 1 comprises a housing member 9 adapted to swing open around a pivotal axis 8 in order to open the impact crusher, and includes a rotor 10 adapted to be rotationally-driven, equipped with crushing elements, not shown in the drawing.

Two impact members 1 and 4, equipped with a multitude of impact elements 11 are provided in a manner facing the rotor 10.

The impact member 1 disposed above the impact member 4, is pivotally mounted around a horizontal axis 2 by way of at least one cylinder 3 or a different drive element engaging in a hinge point 3*a*. At an end of the impact members in the region remote from the axis 2, i.e. at a lower end, a further horizontal axis 6 is provided for pivotally mounting the impact member 4. The gap between the impact members 1, 4 and the rotor 10 can be denoted as crushing chute.

The impact member 4 comprises one or more levers 4*a* on which one or a plurality of cylinders 5 or other drive elements engages/engage at the associated hinge point 5*a*.

The crushing gap 7 is formed by the impact member 4 and the rotor 10.

The material to be crushed, reaching the impact crusher in the direction of the arrow 22, is pre-crushed in the upper region of the crusher and is further crushed by the upper impact member 1, being finally crushed to the pre-set particle size by the lower impact member 4 in the crushing gap 7.

Figure 2:
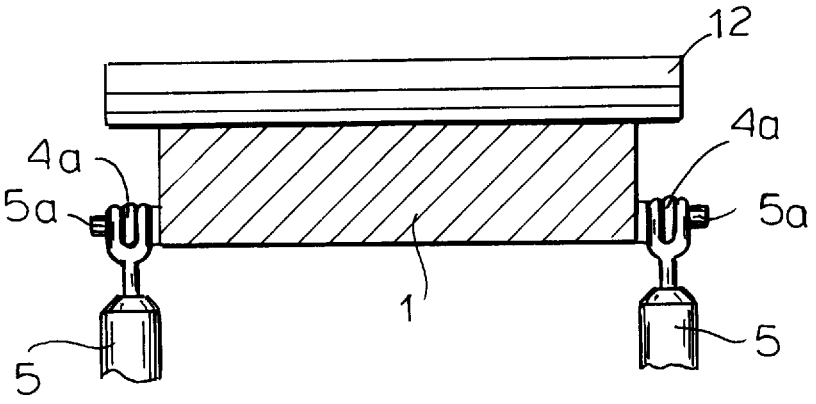
FIG. 2 is a section taken along the line II—II of FIG. 1.
Figure 3:
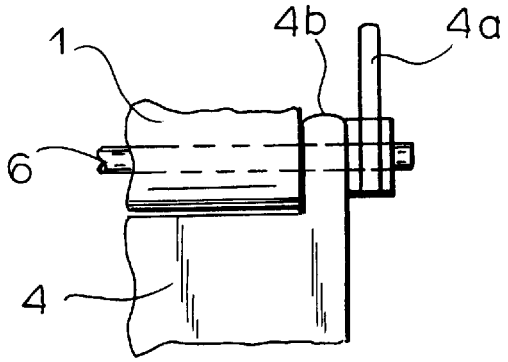
FIG. 3 is a detail view of the connection of the levers with extensions of the second impact member.

From FIG. 2, it will be apparent that two hydraulic cylinder drivers 5 are provided on each side of the impact member 1 and are connected to respective levers 4*a* and from FIG. 3 it can be seen that each lever 4*a* which is rigid with the member 4 is on an extension 4*b* of that impact member to the respective side of the impact member 1.

The impact surfaces of the impact members 1 and 4 are provided at 12 and 13 on the impact members and the pivot axis 8 for the housing part 9 carrying the axis 2 is so arranged with respect to the articulation points 5*a* and the axis 6 that, when the housing part 9 is swung open in the counterclockwise direction and the drives 3 and 5 are correspondingly actuated, there will be no collision between the impact members 1 and 4 and the rotor 10 or the crushing elements thereon.

We claim:

1. An impact crusher comprising:

a housing;

an impact crusher rotor rotatable in said housing about a horizontal rotor axis; and at least one impact member assembly in said housing adjustable relative to said rotor, said assembly including:

a first impact member having impact surfaces juxtaposed with said rotor and pivotally mounted in said housing for movement about a first horizontal pivot axis to shift said surfaces toward and away from said rotor, a first drive means articulated to said first impact member for angularly displacing said first impact member about said first horizontal pivot axis, a second impact member having impact surfaces juxtaposed with said rotor and pivotally mounted in said housing for movement about a second horizontal pivot axis on said first impact member at a location remote from said first horizontal pivot axis to shift said surfaces of said second impact member toward and away from said rotor, lever means swingable about said second horizontal pivot axis and operatively connected with said second impact member for pivotally displacing same about said second horizontal pivot axis, and second drive means articulated to said lever for angularly displacing said second impact member about said second horizontal pivot axis, said lever means comprising a respective lever formed on said second impact member on extensions thereof along said second horizontal pivot axis on opposite sides of said first impact member, each of said levers being pivotally connected with a respective second drive means at a respective articulation point.

2. The impact crusher defined in claim 1 wherein said hinge points and said second horizontal axis being so located so that, upon movement of said first impact member away from said rotor, a gap between said second impact member and said rotor increases.

3. The impact crusher defined in claim 1 wherein said housing includes a movable housing part pivotally connected to a stationary housing part for opening of said crusher and said first axis is provided on said movable housing part.

4. The impact crusher defined in claim 1 wherein said housing includes a movable housing part pivotally connected to a stationary housing part for opening of said crusher and said first horizontal axis is provided on said movable housing part, said points of articulation and said second horizontal pivot axis being arranged relative to a pivot axis of movable horizontal part that collision between said second impact member with said rotor is precluded during opening of said crusher by swinging of said movable housing part.

5. An impact assembly for an impact crusher having a rotor rotatable in a housing about a horizontal rotor axis, said impact assembly cooperating with said rotor to form an adjustable crushing gap, said impact assembly including:

a first impact member having impact surfaces juxtaposed with said rotor and pivotally mounted in said housing for movement about a first horizontal pivot axis to shift said surfaces toward and away from said rotor, a first drive means articulated to said first impact member for angularly displacing said first impact member about said first horizontal pivot axis, a second impact member having impact surfaces juxtaposed with said rotor and pivotally mounted in said housing for movement about a second horizontal pivot axis on said first impact member at a location remote from said first horizontal pivot axis to shift said surfaces of said second impact member toward and away from said rotor, lever means swingable about said second horizontal pivot axis and operatively connected with said second impact member for pivotally displacing same about said second horizontal pivot axis, and second drive means articulated to said lever for angularly displacing said second impact member about said second horizontal pivot axis, said lever means comprising a respective lever formed on said second impact member on extensions thereof along said second horizontal pivot axis on opposite sides of said first impact member, each of said levers being pivotally connected with a respective second drive means at a respective articulation point.

6. The impact assembly defined in claim 5 wherein said hinge points and said second horizontal axis are located so that, upon movement of said first impact member away from said rotor, a gap between said second impact member and said rotor increases.

* * * * *